US006220412B1

(12) United States Patent
Lin

(10) Patent No.: US 6,220,412 B1
(45) Date of Patent: Apr. 24, 2001

(54) TRAVEL BAG CONSTRUCTION

(75) Inventor: Shin-Fu Eiken Lin, Taipei (TW)

(73) Assignee: Paragon Luggage, Inc., Tustin, CA (US)

( * ) Notice: Subject to any disclaimer, the term of this patent is extended or adjusted under 35 U.S.C. 154(b) by 0 days.

(21) Appl. No.: 09/123,096

(22) Filed: Jul. 27, 1998

(51) Int. Cl.[7] ..... A45C 5/14; A45C 13/04
(52) U.S. Cl. ..... 190/127; 190/18 A; 190/122
(58) Field of Search ..... 190/18 R, 18 A, 190/115, 122, 127

(56) References Cited

U.S. PATENT DOCUMENTS

| | | | | |
|---|---|---|---|---|
| 2,781,809 | * | 2/1957 | Wolf | 190/126 |
| 3,084,771 | * | 4/1963 | Davis | 190/113 |
| 3,185,271 | * | 5/1965 | Kotkins | 190/113 |
| 3,349,738 | * | 10/1967 | Kish, Jr. | 190/122 X |
| 3,473,590 | * | 10/1969 | Rohlik | 190/126 X |
| 3,559,778 | * | 2/1971 | D'Elia et al. | 190/127 X |
| 3,962,010 | * | 6/1976 | Riou et al. | 190/122 X |
| 4,036,336 | * | 7/1977 | Burtley | 190/115 X |
| 4,374,555 | * | 2/1983 | March | 190/126 X |
| 4,762,211 | * | 8/1988 | Krenzel | 190/127 X |
| 5,115,895 | * | 5/1992 | Myers | 190/127 X |
| 5,197,579 | * | 3/1993 | Bieber et al. | 190/115 X |
| 5,253,739 | * | 10/1993 | King | 190/115 X |
| 5,368,143 | * | 11/1994 | Pond et al. | 190/115 X |
| 5,447,261 | * | 9/1995 | Mitomi et al. | 190/18 R X |
| 5,476,163 | * | 12/1995 | Wu | 190/127 X |
| 5,529,156 | * | 6/1996 | Yang | 190/127 X |
| 5,566,797 | * | 10/1996 | Van Himbeeck | 190/18 A |
| 5,588,512 | * | 12/1996 | Lin | 190/115 |
| 5,590,748 | * | 1/1997 | Chang | 190/115 X |
| 5,634,538 | * | 6/1997 | Tsai | 190/18 A |
| 5,782,325 | * | 7/1998 | O'Shea et al. | 190/18 A |

* cited by examiner

*Primary Examiner*—Sue A. Weaver
(74) *Attorney, Agent, or Firm*—Jack A. Kanz

(57) ABSTRACT

A rigid frame travel bag equipped with wheels and a retractable handle is formed with a rigid frame assembly which includes a front panel, a rear panel and a shell in the form of a C-shaped bottom panel. The rigid frame members are constructed of extruded plastic material such as acrylonitrile-butadiene-styrene copolymer (ABS) or polyvinyl chloride (PVC). For increased strength and reduced weight, each panel is formed with longitudinally extending cells defined by longitudinally extending ribs. The front and rear panels are attached to the C-shaped bottom panel by integrally formed connecting flanges which extend in overlapping engagement with the inside surfaces of end panel portions extending from the bottom panel. The front and rear panels are also attached to and stabilized on one of the end panel portions by wheel assembly support plates.

33 Claims, 5 Drawing Sheets

TRAVEL BAG CONSTRUCTION

BACKGROUND OF THE INVENTION

Soft-sided hand luggage such as rolling travel bags and the like generally include a rigid frame forming a hard sidewall boundary for a transportable clothing compartment with a flexible fabric enclosure attached to the rigid frame. Such travel bags are usually equipped with wheels and a retractable handle. Hangers may be supported within the compartment of the travel bag so that suits, dresses and the like may be folded, suspended and transported within the bag.

Conventional rolling travel bags usually employ steel or heavily reinforced plastic for the rigid frame. However, the heavy frame structure of conventional travel bags adds substantially to the overall size and weight of the bag while reducing its internal storage capacity. Accordingly, there is a continuing interest in providing rigid frame travel bags equipped with wheels and retractable pull handles which exhibit strength and durability without sacrificing storage volume or increasing the net weight of the bag.

SUMMARY OF THE INVENTION

The present invention provides light-weight rigid frame travel bags which include a soft-sided enclosure. Such bags may include a set of wheels and a retractable pull handle. Travel bags employing the light-weight rigid frame structure of the invention are particularly suitable for handling business suits and dresses as well as small clothing items without significant wrinkling while retaining or exceeding the capacity, compact size and durability characteristics of conventional soft-sided travel bags. The compact bag provided by the invention also accommodates a significant number of soft garments in auxiliary pockets yet remains small enough to fit within overhead carry-on bin compartments of commercial passenger aircraft.

In accordance with the invention, travel bags are made which employ a rigid plastic frame formed by interconnecting a front panel, a rear panel and a C-shaped bottom panel to form a rigid frame which defines the boundaries of a transportable compartment. The C-shaped bottom panel includes first and second end panel portions joined to a substantially flat intermediate panel portion. The plastic frame members are preferably formed by extruding plastic material such as acrylonitrile-butadiene-styrene copolymer (ABS) or polyvinylchloride (PVC) in a form which defines closely spaced flat side panels, sheets or plates joined together by multiple transverse web linking portions. The web linking portions or ribs are separated by cell passages extending longitudinally along the length of the rigid panel. This light-weight, multi-cellular panel construction provides relatively high burst strength and easily withstands the impacts and rough handling normally encountered during travel. However, it is very light and extremely rigid.

In the preferred embodiment of the invention, the bottom panel of the rigid frame is generally channel-shaped or C-shaped in side profile. The front panel and rear panel are captured within the end portions and attached to the bottom panel by suitable connecting means such as integrally formed connecting flanges which overlap the inside surface of an end panel. The opposite ends of the front and rear panels may be attached to the opposite end panel by overlapping interior and exterior support plates of left and right wheel assemblies. The end panels preferably define curved panel portions forming opposite endwall boundaries of the transportable compartment and one end panel is intersected by a handle receptacle notch. The end portion is stiffened and stabilized relative to the bottom panel by a retractable pull handle assembly mounted in the receptacle notch. The pull handle assembly is mounted on the end panel portion by interior and exterior receptacle plates which are curved for conforming, overlapping engagement against the inside and outside surfaces of the end panel portion. The front and rear panels are attached to the bottom panel and to the end panel portions and are structurally stabilized with respect to each other by interior and exterior wheel housing plates which are curved for conforming, flush engagement against the end panel portion.

The structure disclosed is easily formed into rigid frame travel bags which are lighter, sturdier and more durable than prior art bags of comparable size. Various other advantages and features of the invention will become readily understood from the following detailed description taken in connection with the appended claims and attached drawing in which:

Figure 1:
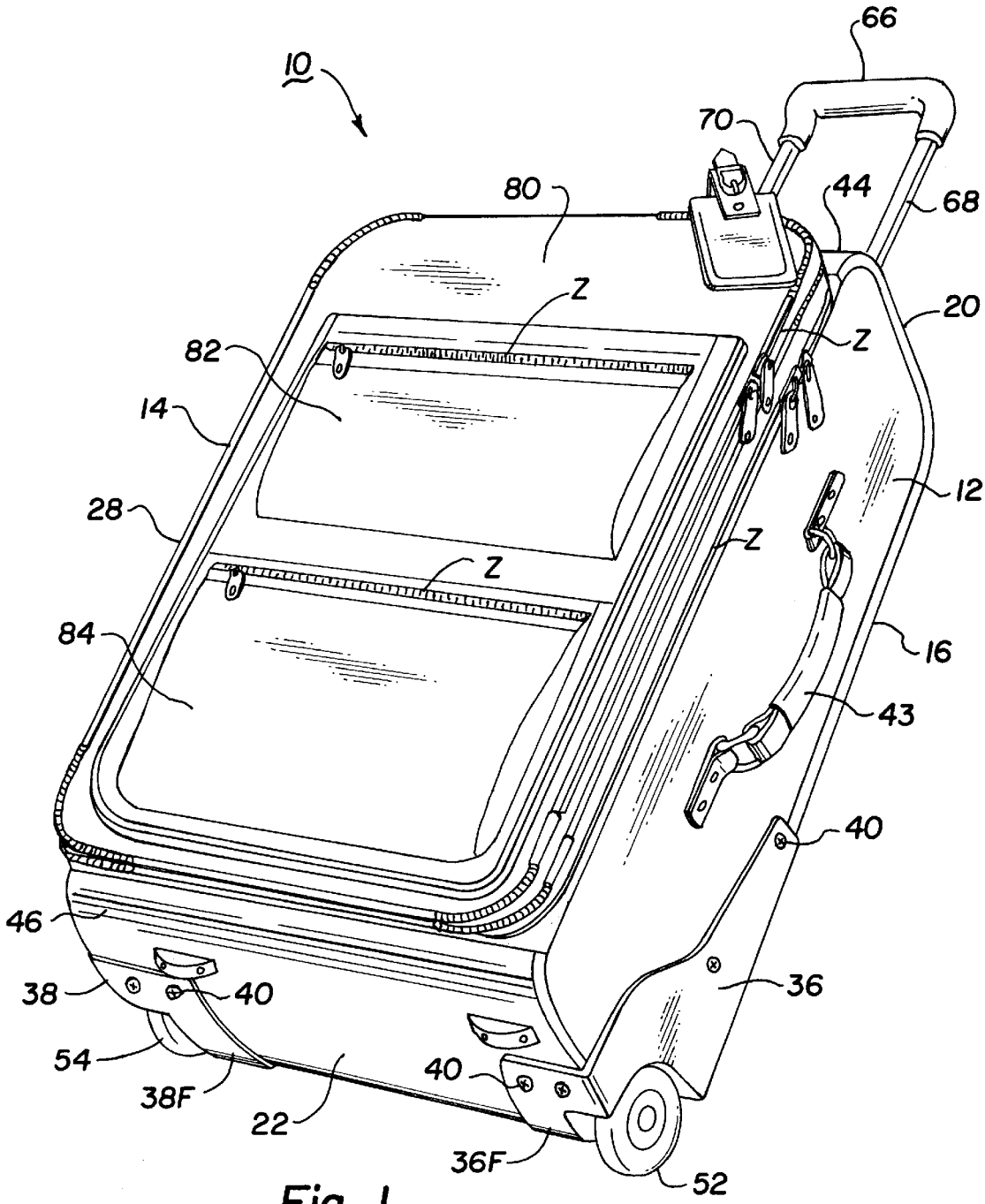
FIG. 1 is a front perspective view of a travel bag including wheels and a retractable pull handle constructed in accordance with the present invention.

The drawing incorporated herein forms a part of the specification to illustrate presently preferred embodiments of the invention. Throughout the drawing, like reference numerals designate corresponding elements. This drawing, together with the description, is for illustrating how the invention can best be made and used. The drawing should not be construed as limiting the invention to the illustrated and described embodiments.

DESCRIPTION OF THE PREFERRED EMBODIMENTS

Figure 2:
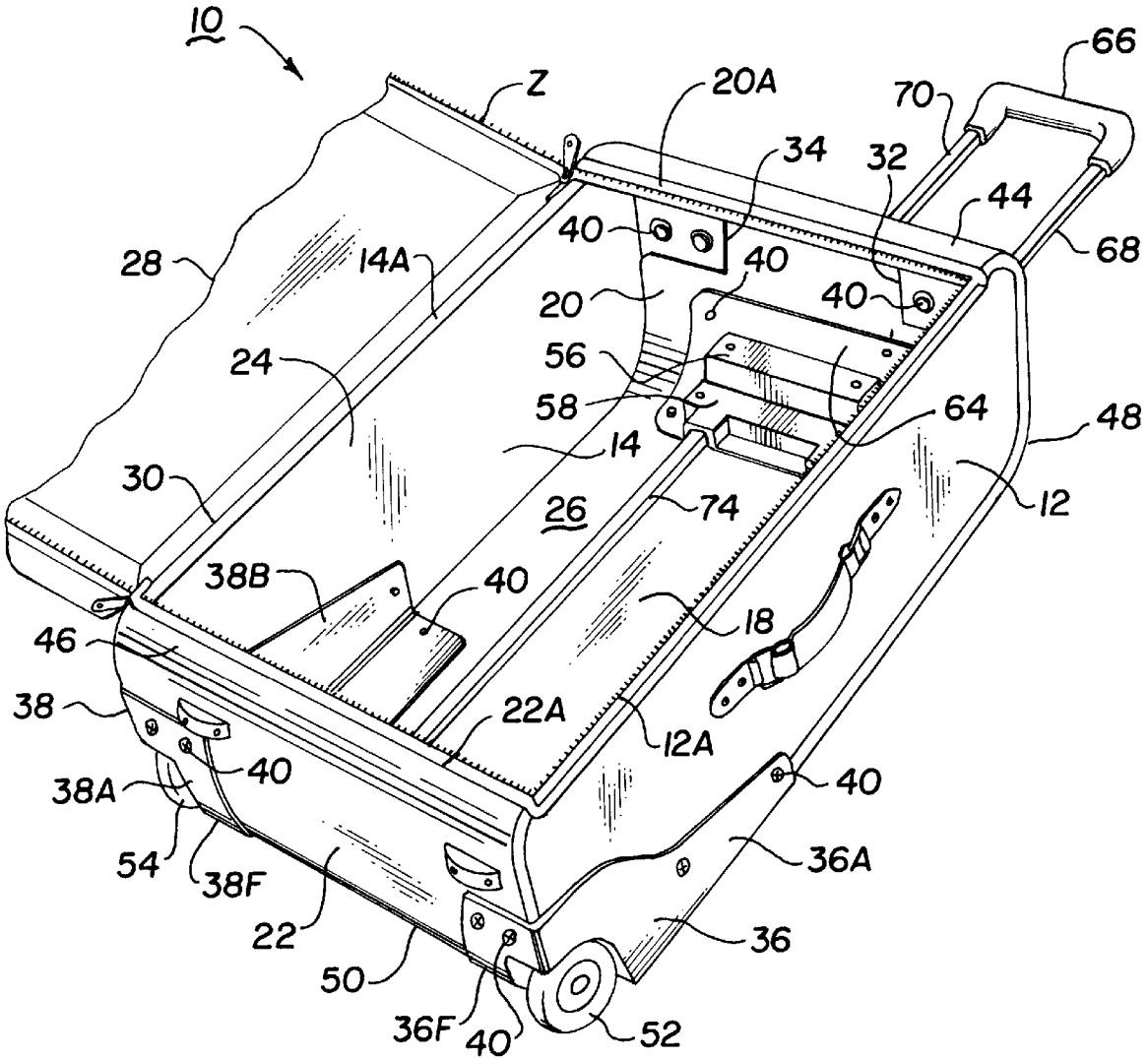
FIG. 2 is a top perspective view of the bag of FIG. 1 with the top closure in the open position.

The drawing illustrates a rigid frame travel bag referred to generally by the reference numeral 10. FIG. 1 shows the top and front of the travel bag in its upright, rolling orientation. FIG. 2 shows the bag 10 open. Most of the description herein is with reference to the orientation of the open travel bag 10 as shown in FIG. 2.

As shown in FIGS. 1 and 2, the travel bag 10 includes generally parallel front and rear panels 12, 14 which are mounted along opposite sides of a generally C-shaped shell 16 having a channel-shaped side profile. The C-shaped shell includes a substantially flat intermediate bottom panel portion 18 connected on opposite ends to left and right wrap-around end portions 20, 22.

Panels 12, 14 include edge portions 12A, 14A and end portions 20, 22 include edge portions 20A, 22A (see FIG.2), which form the perimeter of a generally rectangular access opening 24 to a transportable storage compartment 26. A soft top closure member 28 is moveably coupled by a cloth hinge 30 or the like to the rear panel 14 for movement between a closed position (in which the access opening 24 is covered)

and an open position (in which the access opening and the storage compartment are exposed).

Figure 3:
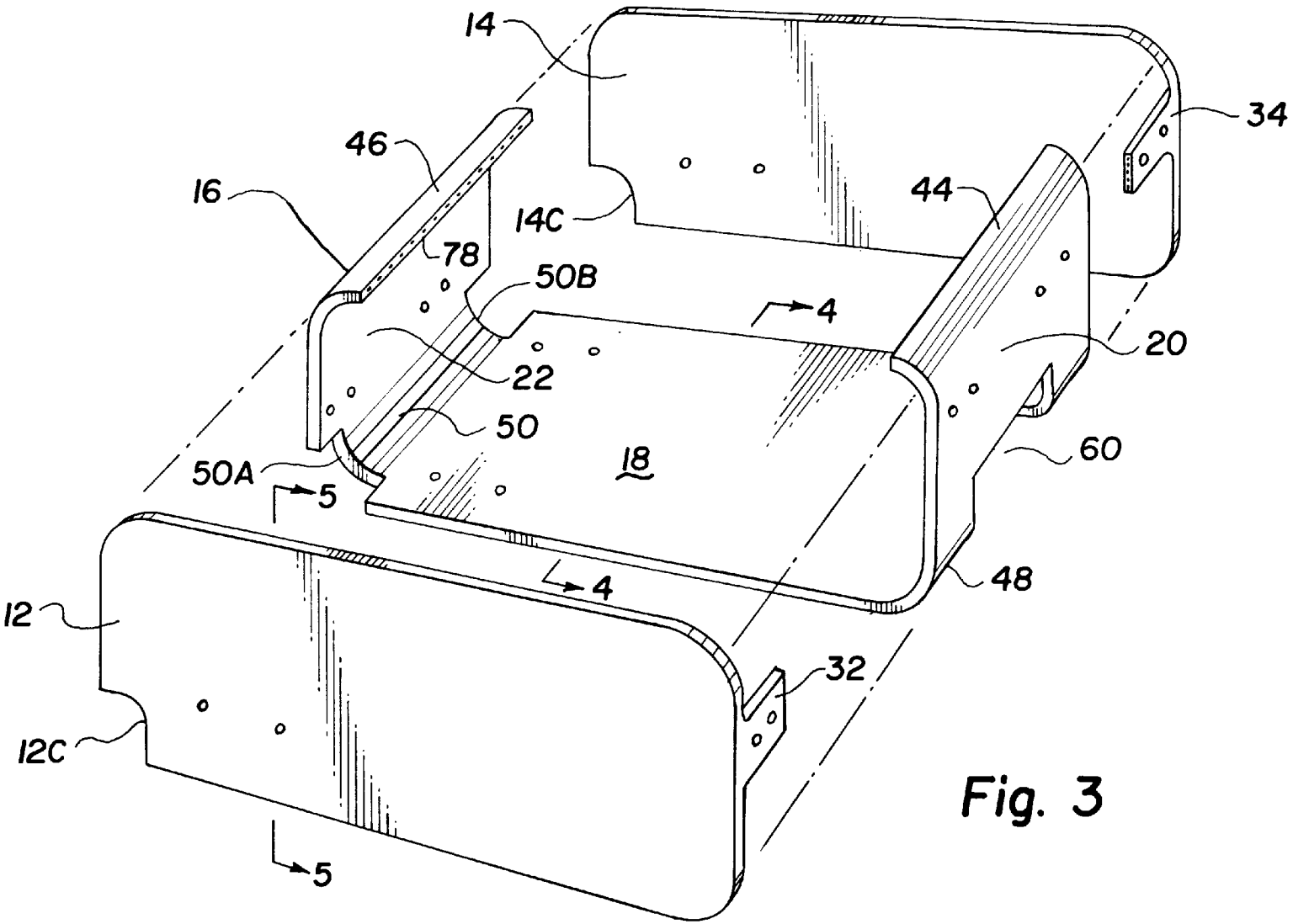
FIG. 3 is an exploded perspective view illustrating the relative arrangement of the rigid frame members.

The front panel 12 and the rear panel 14 are captured in flush engagement within the wrap-around end portions 20, 22. The front and rear panels are attached to the shell 16 by connecting flanges 32, 34 and by wheel assemblies 36, 38 (see FIGS. 2 and 6). While only two (2) flanges 32, 34 are illustrated, it will be recognized that additional or other flanges or the like may be used at other locations to attach the front and rear panels 12, 14 to the shell 16 and/or the end portions 20, 22. Various means, such as spade fasteners, bolts, glue and the like may be used to interconnect the frame components. As illustrated, the front and rear panels 12, 14 are attached to the shell 16 by integrally formed connecting flanges 32, 34 which overlap the inside surface of the wrap-around end portion 20 and are secured to the wrap-around end portion 20 by fasteners 40. Fasteners 40 also attach a lift handle 42 to the outside surface of the wrap-around end portion 20 as shown in FIG. 7. Another lift handle 43 is similarly attached to the front panel 12. In this arrangement the front panel 12 and rear panel 14 are dimensioned and conformed for flush engagement along the inside surface of the flat bottom panel 18 and the wrap-around end portions 20, 22. The front and rear panels are captured within the C-shaped shell by inwardly turned retainer flanges 44, 46 formed on the wrap-around end portions 20, 22, respectively. As shown in FIG. 3, the wrap-around end portions 20, 22 are integrally formed with the flat bottom panel 18. The wrap-around end portions 20, 22 project generally at right angles with respect to the flat bottom panel 18 and are connected thereto by curved panel portions 48, 50 which form smooth transition surfaces.

Figure 6:
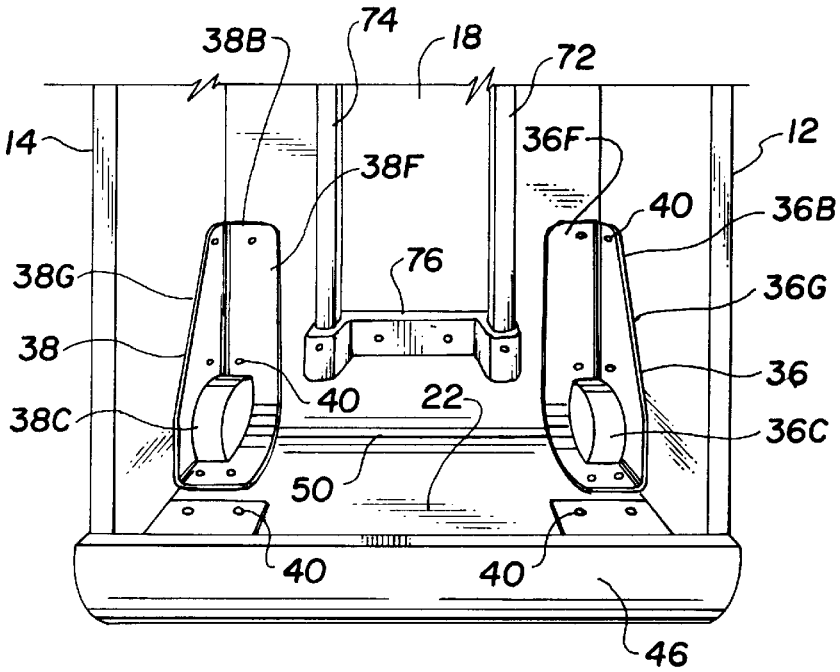
FIG. 6 is a top perspective view, partially broken away, of the transportable storage compartment showing the left and right wheel housing support plates mounted on curved inside surfaces of the rigid frame members.
Figure 7:
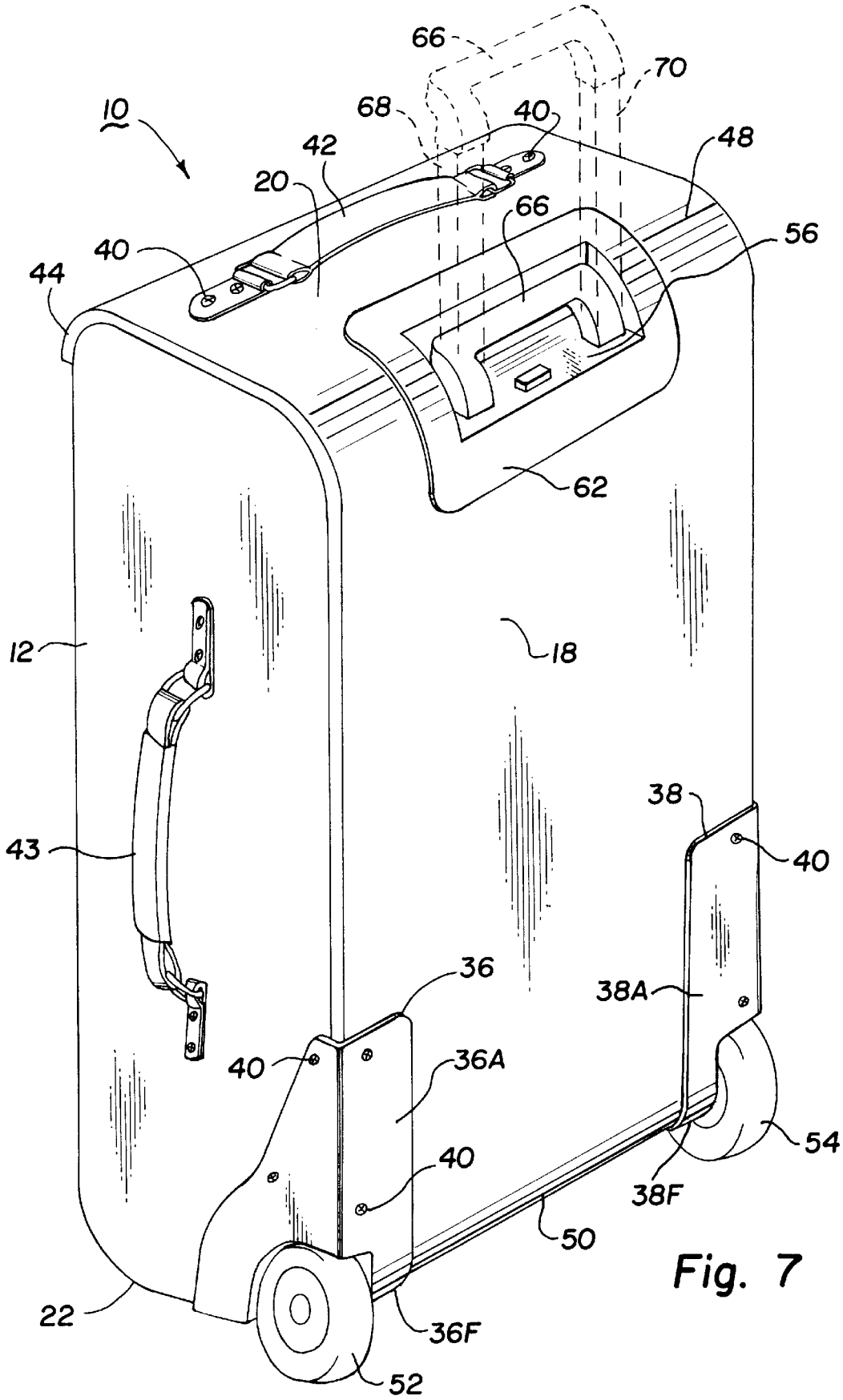
FIG. 7 is a rear perspective view of the travel bag of FIG. 1 showing the attachment of wheel assemblies and a retractable pull handle assembly onto a curved portion of a wrap-around end panel.

As illustrated in FIGS. 2, 3 and 6 the front panel 12 and rear panel 14 are attached to the end portion 22 by wheel assemblies 36, 38. The front panel 12 and the rear panel 14 are intersected by wheel housing notches 12C, 14C for accommodating curved wheel cups 36C, 38C, respectively (see FIG. 6). Likewise, the side edges of the curved portion 50 joining end portion 22 and bottom panel portion 18 of the C-shaped shell 16 are intersected by side notches 50A, 50B aligned with the wheel housing notches 12C, 14C, respectively. The wheel assemblies 36, 38 include outside support plates 36A, 38A and inside support plates 36B, 38B, respectively. The outside and inside support plates each include a wheel cup and are dimensioned for nesting engagement one within the other.

The outside and inside support plates include curved flange portions 36F, 38F which engage the curved outside surface and the curved inside surface of the wrap-around end portion 22. Each wheel assembly also includes a side flange 36G, 38G integrally formed with the curved flange portions 36F, 38F, respectively, and projecting normally therefrom. In this arrangement, the front panel 12, bottom panel 18 and wrap-around end portion 22 are sandwiched between the inside and outside support plates 36A, 36B. A rigid union is established and maintained by fasteners 40 which penetrate through the nested flanges and sandwiched panel portions. Attachment of wheel assembly 38 is identical, with the result that the panels forming the left frame of the travel bag 10 are stabilized and provide rigid support for a set of roller wheels 52, 54. The roller wheels 52, 54 are preferably polyurethane ball-bearing in-line skate wheels or the like.

In FIGS. 2, 3 and 7 a retractable pull handle assembly 56 is shown which includes a handle receiver 58 mounted in a receptacle notch 60 which intersects the curved panel portion 48, the wrap-around end portion 20 and the flat bottom panel 18. The wrap-around end portion 20 is stiffened and stabilized relative to the bottom panel 18 by an external receptacle plate 62 and an internal receptacle plate 64. The receptacle plates are curved for conforming, overlapping engagement against the curved inside and outside surfaces of the curved, wrap-around end portion 20.

The retractable pull handle assembly 56 includes a pull handle 66 attached to parallel extension rods 68, 70. The extension rods are extendable and retractable through parallel guide tubes 72, 74, respectively. The guide tubes 72, 74 are firmly attached to the internal receptacle plate 64 and also are secured to the flat bottom panel 18 near the wrap-around end portion 22 by an anchor bracket 76. The parallel guide tubes further strengthen the bottom panel 18, thereby opposing buckling and collapse caused by compression and bending forces.

Figure 4:
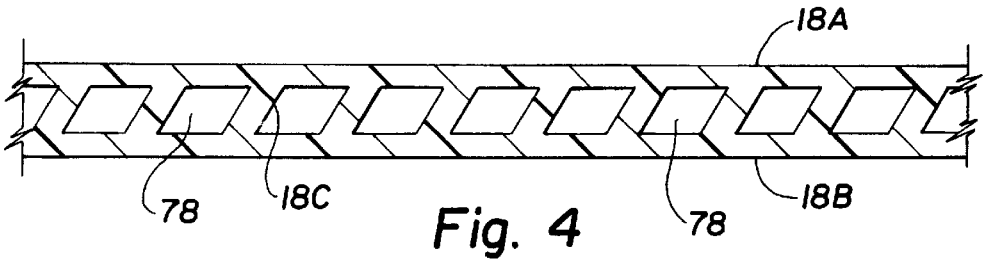
FIG. 4 is a sectional view taken along line 4—4 of FIG. 3 showing the multi-cellular construction of the bottom panel.
Figure 5:
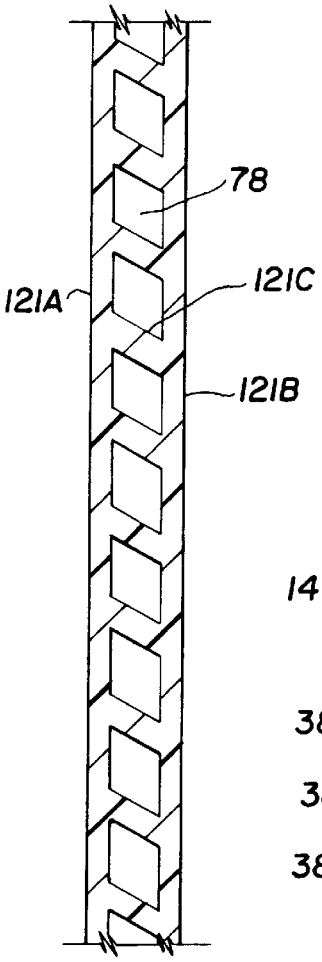
FIG. 5 is a sectional view taken along line 5—5 of FIG. 3 showing the multi-cellular extruded construction of the front panel.

In the preferred embodiment the above-described rigid frame structure is constructed from light-weight high strength plastic panels formed by extruding plastic material such as acrylonitrile-butadiene-styrene copolymer (ABS) or polyvinylchloride (PVC) to form multi-cellular panels as shown in FIGS. 4 and 5. In the sectional view of the flat bottom panel 18 shown in FIG. 4, the extruded panel comprises first and second flat sheets or plates 18A, 18B spaced apart and joined together by multiple transverse web linking portions or ribs 18C. The web linking portions are laterally spaced with respect to each other, thereby forming multiple parallel cells 78 which separate adjacent ribs 18C and extend longitudinally along the length of the rigid panel member. The front and rear panels 12, 14 may have the same multi-cellular construction. As illustrated in FIG. 5 front panel 12 (shown in cross-section) is extruded in the form of first and second flat sheets or plates 121A, 121B spaced apart and joined by transverse web liking portions or ribs 121C which also define multiple parallel channels or cells 78.

Multi-cellular rigid frame members 12, 14, 18 provide increased strength and reduced weight without compromising the internal storage volume capacity of the travel bag 10. Typically, the extruded panel members have a thickness dimension of ¼ inch and the linking web members have a thickness of about 1/64 inch with lateral spacing between the web linking portions approximately 3/16 inch.

The overall dimensions of travel bag 10 are typically about seventeen (17) inches by twenty-four (24) inches by seven (7) inches, making the bag sufficiently small to fit within the overhead bins of commercial airliners. The bag 10 ordinarily includes padding and covering (not illustrated) of conventional heavy fabrics, as such DuPont 1050D ballistic nylon and the like, commonly used for soft-sided luggage.

An assembly of soft auxiliary compartments 80, 82 and 84 may be attached to the outside of the closure member 28 as shown in FIG. 1. Access to the various compartments is provided by heavy-duty self-repairing nylon zippers Z or the like.

In the preferred embodiment the pull handle 66 is covered by a rubberized comfort grip and the extension rods are constructed of industrial strength aluminum rated at about five hundred (500) pounds bending strength. The lift handles 42, 43 are also preferably rated at a pull strength of about five hundred (500) pounds. The additional handle 42 is placed near the retractable handle assembly 56 to allow lifting with two hands when required.

The various panels and components of the invention may be prefabricated using light-weight durable material such as PVC, ABS or the like and may be assembled using only a simple tools such as screwdrivers and nut drivers. ABS and PVC are described herein as preferred construction materials because they are currently considered to be the best materials for constructing the high strength light-weight panels described. However, the panels may be formed of other engineered materials such as polyester or other sheet or molded materials having suitable dimensional stability and sufficient structural strength to provide a novel compact travel bag which is highly durable and impact resistant.

Although the foregoing description refers to a wheeled carry-on travel bag, the invention is not so limited. The construction principles described may be readily applied to larger or smaller travel cases which do not employ wheels or pull handles or which employ wheels, skids or the like positioned at other locations on the frame of the travel bag. For example, the bag may be made with larger dimensions and/or utilize four (4) or more casters secured to the outside surface of bottom panel 18, front panel 12, back panel 14 or either of the end portions 20, 22.

In the embodiment described in detail, the end portions 20, 22 are joined to bottom panel 18 through curved transitions and include inwardly projecting flanges 44, 46 to form smoothly curved wrap-around end portions. It will be readily recognized, however, that such curved construction and inwardly projecting flanges are illustrations of the preferred embodiment and may be eliminated or modified as desired. The C-shaped shell need only have a substantially flat bottom panel 18 supporting oppositely disposed end panels 20, 22 which project from the back panel 18 to produce the novel structure of the invention. Use of a C-shaped shell to which front and back panels are joined to form the frame permits extremely simple and rapid assembly, avoiding many of the bracing structures, etc., used in previous travel bag frames. This structure also permits formation of a travel bag which is much lighter and more sturdy than prior travel bags or cases of similar volume.

Although the invention has been described with reference to exemplary embodiments constructed with certain preferred materials, various changes, substitutions and modifications can be made without departing from the spirit and scope of the invention as defined by the appended claims.

What is claimed:

1. A travel bag including:

(a) a rigid bottom panel having first and second integrally formed end panel portions wherein one of the end panel portions forms a sidewall boundary of a transportable compartment which is intersected by a handle receptacle notch;

(b) a pull handle assembly mounted in said notch which includes an interior receptacle plate disposed within the compartment overlapping an inside surface of the end panel portion and an exterior receptacle plate overlapping the outside surface of the end panel portion;

(c) a substantially rigid front panel extending between and connected to said end panel portions to define one wall of said compartment; and (d) a substantially rigid rear panel extending between and connected to said end panel portions substantially parallel with and spaced from said front panel to define another wall of said compartment.

2. A travel bag as defined in claim 1 wherein said handle is a retractable pull handle which includes at least one guide which extends substantially parallel with the inner surface of said bottom panel toward the other of said end panel portions.

3. A travel bag including:

(a) a rigid bottom panel having first and second integrally formed end panel portions wherein a retractable handle extends parallel with and adjacent the bottom panel from one of the end panel portions toward the other end panel portion and one of the end panel portions forms a sidewall boundary of a transportable compartment which is intersected by a wheel housing notch; and (b) a wheel assembly mounted in the wheel housing notch which includes an interior support plate disposed within the compartment overlapping an inside surface of the end panel portion and an exterior support plate overlapping an outside surface of the end panel portion.

4. A travel bag comprising:

(a) a front panel, a rear panel and a bottom panel having integrally formed end panel portions interconnected to form a rigid frame defining a transportable compartment;

(b) wheel housing notches formed in opposite side edges of one end panel portion;

(c) a wheel housing notch formed in an edge of the front panel;

(d) a wheel housing notch formed in an edge of the rear panel; and (e) a wheel assembly mounted in the wheel housing notch in the front panel which includes (i) an interior support plate having first and second flange portions overlapping inside surfaces of the end panel portion and the front panel; and (ii) an exterior support plate having first and second flange portions overlapping outside surfaces of the end panel portion and the front panel.

5. A travel bag having interconnected rigid frame members defining sidewall boundaries of a transportable compartment, the rigid frame members including a front panel, a rear panel and a bottom panel which has first and second integrally formed end panel portions with said front panel and said rear panel disposed displaced from and substantially parallel with each other between and joined to said first and second end panel portions.

6. A travel bag as defined in claim 5 wherein each rigid frame member is formed of plastic material.

7. A travel bag as defined in claim 5 wherein each rigid frame member is formed of extruded plastic material which includes longitudinally extending cells.

8. A travel bag as defined in claim 5 wherein each rigid frame member is formed of extruded plastic material which includes laterally spaced longitudinally extending ribs.

9. A travel bag as defined in any of claims 6, 7 or 8 wherein the plastic material comprises acrylonitrile-butadiene-styrene copolymer (ABS).

10. A travel bag as defined in any of claims 6, 7 or 8 wherein the plastic material comprises polyvinyl chloride (PVC).

11. A travel bag as defined in claim 5 wherein each rigid frame member is a unitary body comprising first and second sidewall members joined together by web linking portions which form lateral boundaries of cells extending longitudinally along the length of each body.

12. A travel bag as defined in claim 5 wherein the front panel and the rear panel have edge portions disposed in flush engagement with opposite edges of the substantially flat panel portion and the first and second end portions.

13. A travel bag as defined in claim 5 including:

(a) a first connecting flange attached to the front panel disposed in overlapping engagement with one of the end portions; and (b) a second connecting flange attached to the rear panel disposed in overlapping engagement with one of the same end portions.

14. A travel bag as defined in claim 13 wherein one connecting flange is integrally formed with the front panel and the other connecting flange is integrally formed with the rear panel.

15. A travel bag as defined in claim 5 wherein the end panel portions comprise curved wrap-around panel portions forming opposite sidewall boundaries of the transportable compartment.

16. A travel bag as defined in claim 5 wherein the first and second end panel portions are integrally formed with the substantially flat bottom panel portion to define a bottom panel which is generally C-shaped in side profile.

17. A travel bag as defined in claim 5 including a first connecting flange integrally formed with the front panel member and a second connecting flange integrally formed with the rear panel member, the front and rear panel members including side edge portions engaging inside surfaces of the bottom panel and inside surfaces of the first and second end panel portions when the first and second connecting flanges are disposed in overlapping engagement with the inside surface of one of the end panel portions.

18. A travel bag as defined in claim 5 wherein the first and second end panel portions each include an inwardly projecting flange.

19. A travel bag as defined in claim 5 including first and second curved panel segments connecting the first and second end panel portions to opposite ends of the flat bottom panel portion.

20. A travel bag as defined in claim 5 wherein:

(a) the rigid frame members include edge portions defining the perimeter of a generally rectangular access opening into the transportable compartment; and (b) closure member is moveably coupled to one of the rigid frame members for movement between a closed position in which the access opening is covered and an open position in which the access opening is exposed.

21. A travel bag as defined in claim 5 wherein:

(a) the first end panel portion is intersected by a handle receptacle notch; and (b) a retractable pull handle assembly is mounted in the receptacle notch with an interior receptacle plate disposed within the compartment overlapping an inside surface of the first end portion and an exterior receptacle plate overlapping an outside surface of the first end portion.

22. A travel bag as defined in claim 5 wherein:

(a) the second end panel portion is intersected by a wheel housing notch; and (b) a wheel assembly is mounted in the wheel housing notch which includes an interior support plate disposed within the compartment overlapping an inside surface of the second end panel portion and an exterior support plate overlapping an outside surface of the second end panel portion.

23. A travel bag as defined in claim 22 wherein the interior support plate includes first and second flange portions overlapping inside surfaces of the second end panel portion and the front panel member and the exterior support plate includes first and second flange portions overlapping outside surfaces of the second end panel portion and the front panel member.

24. A travel bag having interconnected rigid frame members including:

(a) a unitary C-shaped structure defined by a bottom panel with first and second integrally formed end panel portions projecting therefrom which form opposite sidewall boundaries of a transportable compartment;

(b) a substantially rigid front panel extending between and connected to said end panel portions to define one wall of the compartment; and (c) a substantially rigid rear panel extending between and connected to said end panel portions substantially parallel with said front panel to define another wall of the compartment.

25. A travel bag as defined in claim 24 wherein said bottom panel with integrally formed end panel portions is a unitary body of extruded plastic material which includes longitudinally extending cells.

26. A travel bag as defined in claim 25 wherein said extruded plastic material is essentially acrylonitrile-butadiene-styrene copolymer (ABS).

27. A travel bag having interconnected rigid frame members defining sidewall boundaries of a transportable compartment, the rigid frame members including a front panel, a rear panel and a bottom panel which has first and second integrally formed end panel portions with said front panel and said rear panel disposed between and joined to said first and second end panel portions, wherein:

(a) the second end panel portion is intersected by a wheel housing notch; and (b) a wheel assembly is mounted in the wheel housing notch which attaches said second end panel to said front panel.

28. A travel bag as defined in claim 27 wherein said wheel assembly includes an interior support plate disposed within the compartment overlapping an inside surface of the second end panel portion and an exterior support plate overlapping an outside surface of the end panel portion.

29. A travel bag as defined in claim 28 wherein the interior support plate includes first and second flange portions overlapping inside surfaces of the second end panel portion and the front panel member and the exterior support plate includes first and second flange portions overlapping outside surfaces of the second end panel portion and the front panel member.

30. A travel bag having interconnected rigid frame members defining sidewall boundaries of a transportable compartment, the rigid frame members including a front panel, a rear panel and a bottom panel which has first and second integrally formed end panel portions with said front panel and said rear panel disposed between and joined to said first and second end panel portions, wherein (a) the second end panel portion is intersected by a wheel housing notch; and (b) a wheel assembly is mounted in the wheel housing notch which includes an interior support plate disposed within the compartment overlapping an inside surface of the second end panel portion and an exterior support plate overlapping an outside surface of the second end panel portion.

31. A travel bag as defined in claim 30 wherein the interior support plate includes first and second flange portions overlapping inside surfaces of the second end panel portion and the front panel member and the exterior support plate includes first and second flange portions overlapping outside surfaces of the second end panel portion and the front panel member.

32. A rigid travel bag frame comprising:

(a) a rigid unitary bottom panel having integrally formed end panel portions which defines the bottom and two opposite ends of a transportable compartment;

(b) a rigid front panel;

(c) first means connecting said bottom panel with the front panel;

(d) a rigid rear panel;

(e) second means connecting said bottom panel with the rear panel so that the rear panel is substantially parallel with and spaced from the front panel and so that said bottom panel, said end panel portions, said front panel and said rear panel define five interconnected sides of a travel bag; and (f) a wheel assembly attached to said bottom panel.

33. A travel bag frame as defined in claim 32 wherein said first means is a flange integrally formed on said front panel and disposed in overlapping engagement with an end panel portion and said second means is a flange integrally formed on said rear panel and disposed in overlapping engagement with an end panel portion.

* * * * *

UNITED STATES PATENT AND TRADEMARK OFFICE

CERTIFICATE OF CORRECTION

PATENT NO. : 6,220,412 B1
DATED : April 24, 2001
INVENTOR(S) : Shin-Fu (Eiken) Lin It is certified that error appears in the above-identified patent and that said Letters Patent is hereby corrected as shown below:

Column 1,
Between "TRAVEL BAG CONSTRUCTION" and "BACKGROUND OF THE INVENTION" the following paragraph should be inserted:
-- This invention relates to hand luggage. More particularly, it relates to soft-sided travel bags of rigid frame construction. --

Column 7,
Line 15, between "(b)" and "closure member" insert -- a --

Signed and Sealed this

Twenty-ninth Day of July, 2003

JAMES E. ROGAN
*Director of the United States Patent and Trademark Office*